United States Patent [19]

Baer

[11] Patent Number: 4,999,880

[45] Date of Patent: Mar. 19, 1991

[54] PINLESS HINGE STRUCTURE ROTATABLE THROUGH AN EXTENDED ARC OF TRAVEL

[76] Inventor: Austin R. Baer, 1115 N. Ellsworth, Villa Park, Ill. 60181

[21] Appl. No.: 432,576

[22] Filed: Nov. 6, 1989

[51] Int. Cl.[5] ..... E05D 7/00

[52] U.S. Cl. ..... 16/354; 16/366

[58] Field of Search ..... 16/354, 265, 267, 271, 16/366

[56] References Cited

U.S. PATENT DOCUMENTS 3,402,422 9/1968 Baer ..... 16/366

FOREIGN PATENT DOCUMENTS 679178 2/1964 Canada ..... 16/354

*Primary Examiner*—Richard K. Siedel
*Assistant Examiner*—Carmine Cuda
*Attorney, Agent, or Firm*—Gravely, Lieder & Woodruff

[57] ABSTRACT

A pinless hinge structure having two hinge members which are rotatable relative to each other through an angle greater than 180 degrees. The hinge members are rotatably joined along their adjacent longitudinal edges by mutually intermeshed gear segments which are maintained in rotatable association by a clamp member. Each hinge member is further configured with a leg segment extending outwardly from each gear segment. The leg segments and the clamp member are configured to allow the hinge members to rotatably traverse a greater than 180 degree arcuate path of travel relative to each other.

20 Claims, 1 Drawing Sheet

PINLESS HINGE STRUCTURE ROTATABLE THROUGH AN EXTENDED ARC OF TRAVEL

FIELD OF THE INVENTION

The present invention generally relates to hinge structures and, more particularly, to a pinless hinge structure which allows for rotation of the hinge through an angle of greater than 180 degrees.

BACKGROUND OF THE INVENTION

A hinge structure normally includes two hinge members which are substantially similar and are rotatably secured to each other by a pin or the like. Such hinge members structures normally allow for rotation of the hinge members relative to each other through an angle of 180 degrees or more.

My U.S. Pat. No. 3,092,870 dated June 11, 1963, discloses a pinless hinge structure offering increased performance and durability. Such a hinge structure includes two longitudinally extending hinge members which are rotatably joined along their adjacent longitudinal edges by intermeshing gear segments forming part of the hinge members. A clamp member maintains the gear segments in mesh relative to each other while permitting smooth and uniform movement of the hinge through an angle of 180 degrees.

In many instances, however, there is a desire for a hinge structure which allows for a greater angle of opening. As an example, a rear cargo door of a truck advantageously swings outwardly and away from a truck body. A hinge structure having a throw of less than 270 degrees will restrict door movement on the truck. Accordingly, at the end of its arcuate travel, the cargo door either extends rearwardly of the truck body or outwardly from the side of the truck body. In either position, the open cargo door occupies valuable space especially in truck bays having limited space constraints. The durability and outward appearance of the hinge structure is also an important consideration when designing hinge structures.

SUMMARY OF THE INVENTION

In view of the above, and in accordance with the present invention, there is provided a pinless hinge structure having two hinge members which are rotatable relative to each other through an angle greater than 180 degrees and preferably at least about 270 degrees. The hinge members are rotatably joined along their adjacent longitudinal edges by gear segments which permit smooth and uniform movement of the hinge members. The hinge members are maintained in intermeshing engagement by a clamp member.

Each hinge member further includes a leg segment which extends outwardly from the longitudinally extending gear segment. The leg segments and an exterior surface on the clamp member are configured to allow the hinge members to smoothly and uniformly traverse an extended arcuate path of travel between their normally open and normally closed positions.

The leg segments of each hinge member define inner and outer surfaces. At least a portion of the inner surface on each of the leg segments are proximate to each other when the hinge members are arranged in a closed position. When the hinge members are rotated into their fully open position, at least a portion of the outer surfaces of each hinge member abut against at least a portion of an exterior surface defined on the clamp member.

Unlike most hinge structures having substantially similar hinge members, each hinge member of the present invention has a unique design. In the illustrated embodiment the leg segment of one hinge member has a generally L-shaped configuration. Preferably, each hinge member has a seat provided on an outer surface of the leg segment. The seat has a profile which generally corresponds to and, upon adequate rotation of the hinge member, abuts against a portion of the exterior surface on the clamp member.

The clamp member which maintains the gear segments of the hinge members in mutually interengaging relation rotatably moves in response to rotation of either hinge member. The clamp member is a generally C-shaped channel-like member having longitudinal rod-like bearing portions at its inwardly turned ends. The clamp member has an outer surface with portions thereof preferably formed as radii with centers common to the centers of the rod- like bearing portions.

The rod-like portions at each end of the clamping member are accommodated in longitudinally extending channels defined by the gear segments of the hinge members. In a preferred embodiment, the rod-like bearing portions rotatably engage the gear segments of the hinge members at an axis of rotation thereof such that upon rotation of either hinge member, the clamp member rotates approximately half the angular distance traversed by the hinge member that is moved.

A salient feature of the present invention is the ability of the hinge members to rotate through an angle of greater than 180 degrees and preferably at least about 270 degrees. The unusual geometry of the hinge members and the clamp member along with their continuous lines make the extended arc design easy to achieve without sacrificing hinge appearance. Thus, the hinge structure of the present invention finds utility for a myriad of applications and uses.

Numerous other features and advantages of the present invention will become readily apparent from the following detailed description, the accompanying drawings and the appended claims.

DETAILED DESCRIPTION OF A PREFERRED EMBODIMENT

Figure 1:
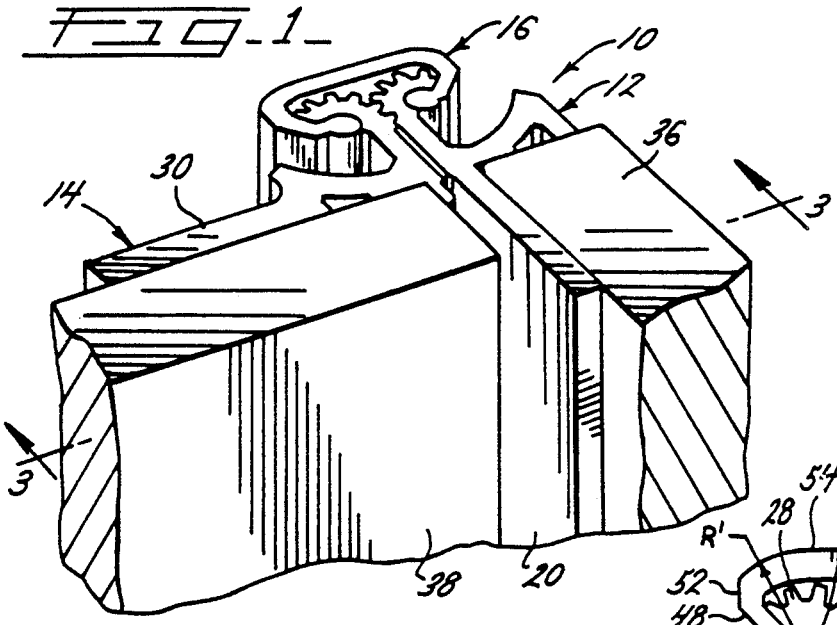
FIG. 1 is a perspective view of the hinge structure of the present invention as employed to provide a hinged connection between door panels.

While the present invention is susceptible of embodiment in various forms, there is shown in the drawings, and will hereinafter be described, a preferred embodiment of the present invention with the understanding that the present disclosure is to be considered as an exemplification of the invention which is not intended to limit the invention to this specific embodiment illustrated.

Referring now to the drawings, wherein like reference numerals indicate like parts throughout several views, there is illustrated a pinless hinge structure 10.

As illustrated, the pinless hinge structure 10 includes first and second longitudinally extending hinge members 12, 14 respectively, which are rotatably joined along their adjacent longitudinal edges. A longitudinally extending clamp member 16 maintains the hinge members 12, 14 in rotatable engagement relative to each other.

The hinge members can be formed from a wide variety of metals, plastics, and other materials, and can be fabricated by machining the elements from stock of appropriate cross section, or by rolling, drawing, die-casting, or preferably, by extruding these materials. In the later case, any extrudable material of the requisite strength may be employed such as a brass, aluminum, thermoplastic polymers, and the like.

Figure 2:
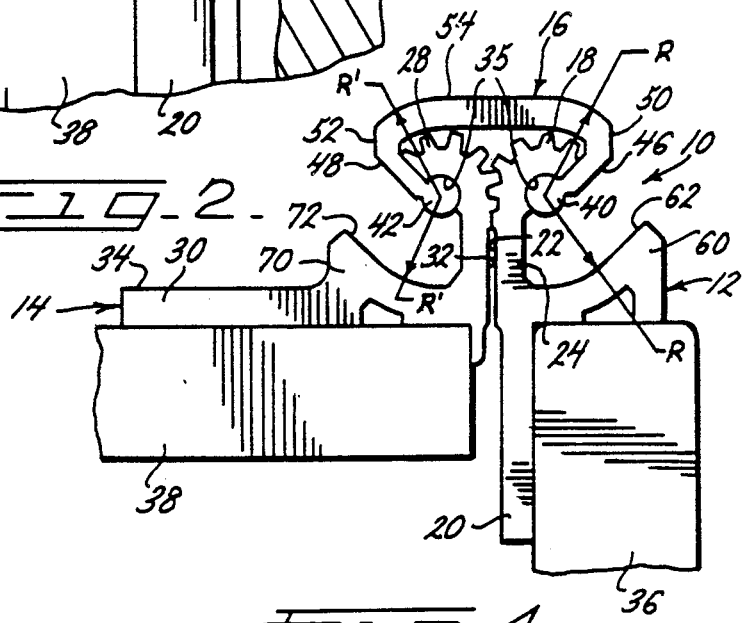
FIG. 2 is a top plan view of the hinge structure of the present invention in a closed position.

Turning now to FIG. 2, the first hinge member 12 is formed with a longitudinally extending gear segment 18 at one longitudinal edge and has an outwardly extending leg segment 20 joined thereto. Leg segment 20 includes inner and outer surfaces 22 and 24, respectively. The second hinge member 14 includes a longitudinally extending gear segment 28 at one longitudinal edge and has an outwardly extending leg segment 30 joined thereto. As illustrated, leg segment 30 has a generally L-shaped configuration and includes inner and outer surfaces 32 and 34, respectively. The portion of the leg segment 20 which leads up to and connects with the gear segment 18 for the hinge member 12 constitutes the initial leg segment of the hinge member 12. Likewise, the portion of the leg segment 30 which leads up to the gear segment 28 constitutes the initial leg segment for the hinge member 14. The initial leg segments of the two hinge members 12 and 14 lie parallel and generally together when the hinge members are closed (FIG. 2).

The gear segments 18, 28 each include a series of gear teeth. The gear teeth are preferably arranged on surfaces having the same radii. One gear segment, however, could have a series of teeth arranged on a surface having a radius which is slightly different from the geared surface of the adjacent gear segment. Alternatively, the geared surfaces of the gear segments could have spiral configurations wherein one gear segment has an increasing radius and the other gear segment has a decreasing radius as long as the sum of the radii is a constant through the range of rotation.

Each gear segment 18, 28 defines a longitudinal channel 35 which provides each gear segment with a longitudinally extending cylindrical surface which coincides with ,the axis of rotation of the respective segments 18, 28. As shown in FIG. 2, the apex of each gear segment is generally coincident with the axis of rotation of the gear segment and the gear teeth of the gear segments of 18, 28 mutually intermesh with each other to rotatably join the hinge members 12, 14 to each other throughout their range of relative movement. As illustrated, each gear segment circularly extends in cross section through an angle of somewhat more than 90 degrees and preferably about 135 degrees.

The leg segments 20, 30 of the hinge members 12, 14, respectively, are secured to door panels 36 and 38. As will be understood, the leg sections of the hinge members can be configured and/or extended to provide, for example, an intrinsically formed door jamb or channel for window or plate glass, and etc.

As illustrated in FIG. 2, the longitudinal extending clamp member 16 has a generally channel shaped or C-shaped cross section. Being C-shaped, the clamp member 16 has a connecting portion and legs which turn inwardly from the connecting portion. Indeed, the legs converge beyond the connecting portion. The inwardly turned ends or legs of clamp member 16 are formed with longitudinal extending rod-like bearing portions 40, 42 which cooperate with the cylindrical bearing surfaces defined by channels 35 at the axis of rotation of each hinge member.

The outer or exterior surface of clamp member 16 has a multi-faceted configuration which, as described below, combines with the outer surfaces 24, 34 of leg segments 20, 30, respectively, to permit the hinge members to rotate more than 180 degrees and preferably about 270 degrees relative to each other. As illustrated, clamp member has an outer surface including facets 46, 48 which extend in opposite angular directions away from the rod-like portions 40, 42, respectively, of the clamp member 16 such that each facet 46, 48 defines an included angle of about 135 degrees between it and a respective portion of outer surface of leg sections 20, 30. At their outer end, facets 46, 48 are joined to facets 50, 52, respectively. As illustrated, facets 50, 52 are joined to each other by a profiled surface 54. The profiled surface 54 includes essentially radiused or cylindrical segments R and R′ extending from the facets 50 and 52, respectively. As illustrated, the apex of each radiused or cylindrical segment R and R′ is substantially coincident with the axis of rotation of hinge members 12 and 14, respectively.

In the illustrated embodiment, leg segment 20 of hinge member 12 further includes a seat 60 which extends outwardly and away from outer surface 24 of leg segment 20. Seat 60 provides two functions. First, seat 60 acts as a stop which limits relative rotation between clamp member 16 and hinge member 12 in a first direction. Second, seat 60 acts to retain the clamp member 16 in position relative to the hinge member 12 upon extended travel or movement of the hinge structure. As illustrated, seat 60 has a radiused profile 62 including a radiused segment R. As illustrated, the apex of the radiused segment R of profile 62 is substantially coincident with the axis of rotation of hinge member 12 and substantially corresponds to the radiused segment R on profiled surface 54 of clamp member 16.

Similarly, leg segment 30 of hinge member 14 is preferably formed with a seat 70 which extends outwardly and away from outer surface 32 of leg segment 28. To add strength and durability to the design, each seat 60, 70 is preferably formed as an integral part of the leg segment from which it projects. Seat 70 likewise provides two functions. First, seat 70 acts as a stop which limits relative rotation between clamp member 16 and hinge member 14 in a second direction. Second, seat 70 acts to retain the clamp member 16 in position relative to the hinge member 14 upon extended travel or movement of the hinge structure. As illustrated, seat 70 has a radiused profile 72 including a radiused segment R′. As illustrated, the apex of the radiused segment R′ of profile 72 is substantially coincident with the axis of rotation of hinge member 14 and substantially corresponds to the radiused segment R′ on profiled surface 54 of clamp member 16.

Figure 3:
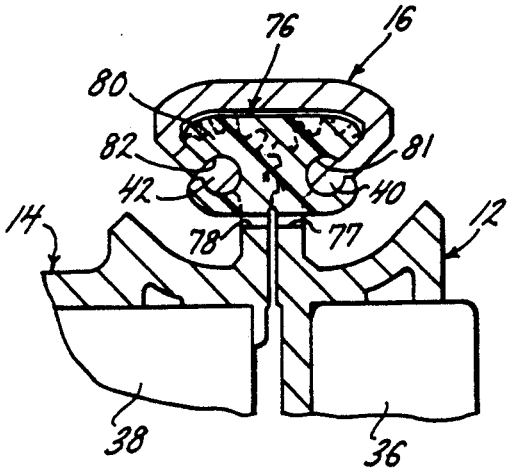
FIG. 3 is a partial sectional view taken along line 3—3 of FIG. 1.

The hinge members 12, 14 comprising the hinge structure are interconnected by the longitudinally extending, mutually intermeshed gear segments 18, 28 and by the longitudinal engagement of the rod-like portions 40, 42 with channels 34. As illustrated in FIG. 3, a thrust bearing assembly 76 inhibits longitudinal movement of the hinge members 12, 14 relative to each other.

As may be appreciated, more than one thrust bearing assembly may be provided along the length of the hinge structure to distribute the load bearing capability of hinge structure over the length thereof. For purposes of discussion, however, only one thrust bearing assembly will be discussed in detail with the understanding that the other thrust bearing assemblies disposed along the length of the hinge structure may be substantially similar in construction.

As illustrated in FIG. 3, the hinge members 12, 14 define longitudinally co-extensive lateral recesses 77 and 78, respectively, along adjacent longitudinal edges thereof. The thrust bearing assembly 76 is disposed within the lateral recesses 77 and 78 defined by the hinge members. The thrust bearing assembly 76 may be of the type disclosed in my U.S. Pat. No. 3,402,422, dated Sept. 24, 1968; the entirety of which is incorporated herein by reference.

As illustrated in FIG. 3, thrust bearing assembly 76 includes a thrust bearing member 80 which extends across adjacent longitudinal edges of the hinge members 12, 14 to inhibit relative movement therebetween. The longitudinal dimensions of the thrust bearing member 80 and the recesses 77, 78 are such that there is just sufficient clearance therebetween to permit the hinge members 12, 14 to swing or be rotated in an arcuate path of travel without binding on the thrust bearing assembly.

The thrust bearing member 80 advantageously has a cross section that conforms essentially to the cross-sectional configuration of the interior of clamp member 16 such that upper and lower bearing surfaces defined by the thrust bearing member 80 offer relatively large planer surface areas for supporting the hinge members. As illustrated, the thrust bearing member 80 defines a pair of longitudinal extending channels 81 and 82 that accommodate the rod-like bearing portions 40, 42, respectively, of the clamp member 16 and through which the rod-like bearing portions longitudinally extend. Preferably, the thrust bearing assembly is formed from a non-metallic material such as acetal resin-type plastic. Such materials are commonly sold under the trade name "Delrin" by DuPont Corporation.

The hinge structure 10 is assembled by placing the gear segments 18, 20 of the hinge members 12, 14, respectively, in mutually intermeshing engagement. The hinge members 12, 14 are longitudinally moved relative to each other until the lateral recesses 76, 78 defined thereby are co-extensively and laterally aligned.

After properly aligning the hinge members 12, 14 relative to each other, the clamp member 16 is assembled to the hinge structure as by sliding movement. The rod-like bearing portions 40, 42 of the clamp member 16 are slidably accommodated in the channels 35 in a manner maintaining the hinge members 12, 14 in rotatably joined relation relative to each other. As the clamp member is longitudinally moved relative to the hinge members 12, 14, the rod-like bearing portions 40, 42 move through and are accommodated within the channels 81, 82 of each bearing member 80, and each thrust bearing may be inserted into its corresponding lateral recess, to be locked in position by the clamp member 16.

FIG. 2 illustrates the hinge structure 10 in a first or closed position. In this position, at least a portion of the inner surfaces 22, 32 of the hinge members 12, 14, respectively, are arranged in a proximal relation. As illustrated, in the closed position, door panels 36 and 38 extend generally perpendicular relative to each other.

Figure 4:
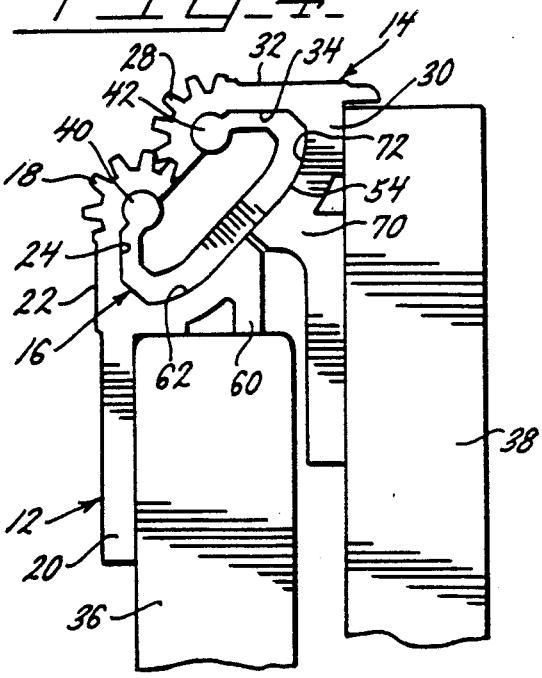
FIG. 4 is a top plan view of the hinge structure of the present invention in an open position.

FIG. 4 illustrates the hinge structure in a second or open position. In the second position, the hinge member 14 has been rotated about 270 degrees to allow door panel 38 to assume a substantially parallel relation with door panel 36. As will be appreciated, rotation of the hinge member 14, from the position illustrated in FIG. 2, toward the position illustrated in FIG. 4 will cause seat 72 to engage the exterior surface of the clamp member 16. Preferably, seat 70 has a profile 72 which compliments the multi-faceted exterior surface of the clamp member 16.

After seat 70 engages the exterior surface 54, of the clamp member 16, both the hinge member 14 and clamp member 16 are rotated in unison towards the position illustrated in FIG. 4. As the hinge member 14 rotates, the clamp member 16 maintains the gear segments 18, 28 in mesh relative to each other to permit smooth and uniform movement of the hinge members through the full arc of travel of the hinge. Upon extended arcuate movement of the hinge structure, the engagement of seat 70 with the exterior surface retains the clamp member 16 in position relative to the hinge member 14.

As illustrated in FIG. 4, in an open or second position, at least a portion of the outer surface 24, 34 of each hinge member 12, 14, respectively, abuts with at least a portion of the exterior surface defined on the clamp member 16. As will be understood, seat 60 on the hinge member 12 limits or stops rotation of the clamp member 16 and thereby hinge member 14 after hinge member 14 has been rotated at least about 270 degrees relative to hinge member 12. Upon extended arcuate movement of the hinge structure, the engagement of seat 60 with the exterior surface retains the clamp member 16 in position relative to hinge member 12.

This invention has been described in terms of a specific embodiment set forth in detail, but it should be understood that this is by way of illustration only and that the invention is not necessarily limited thereto. Modifications and variations will be apparent from the disclosure and may be resorted to without departing from the spirit of the invention, as those skilled in the art will readily understand. Accordingly, such variations and modifications of the disclosed products are considered to be within the purview and scope of the invention and the following claims.

What is claimed is:

1. A hinge capable of accommodating swings substantially in excess of 180°, said hinge comprising: a first hinge member having a gear segment and an initial leg segment extended from the gear segment, the gear segment having a bearing surface located behind its gear teeth; a second hinge member having a gear segment and an initial leg segment extended from its gear segment, the teeth on the gear segment of the second hinge member meshing with the teeth on the gear segment for the first hinge member as one hinge member moves relative to the other between a closed position, wherein the initial leg segments are generally together, and open positions, wherein the initial leg segments are spread apart, the gear segment of the second hinge member further having a bearing surface that is located behind its teeth, whereby the bearing surfaces of the two hinge members face in generally opposite directions; a clamp member fitted over the gear segments and having along its edges bearing surfaces which contact the bearing surfaces of the gear segments and hold the gear segments together with their teeth meshing in the open and closed positions, the clamp member having two legs which lead up to and carry the bearing surfaces of the clamp member and a connecting portion located between the two legs, the legs converging beyond the connecting portion and otherwise being located such that the leg segments of the hinge members approach them as the hinge members move into open positions, the hinge members reaching a fully open position, which is beyond 180° from the closed position, when the converging legs of the clamp member interfere with the leg segments of the hinge members, whereby the one hinge member can swing in excess of 180° with respect to the other hinge member.

2. The pinless hinge structure according to claim 1 wherein said clamp member rotates upon movement of either hinge member and includes a faceted outer surface which cooperates with outer surfaces on said hinge members to limit relative movement between the hinge members and clamp member.

3. A hinge according to claim 1 wherein the hinge members have seats which are spaced from the gear segment and located generally behind the bearing surfaces of the gear segment; and wherein the seats bear against the connecting portion of the clamp member when the hinge members assume the fully open position.

4. A hinge according to claim 3 wherein the initial leg segments of the hinge members lie between the gear segments and the seats; and wherein the legs of the clamp member bear against the initial leg segments when the hinge members are in their fully open position.

5. A hinge according to claim 3 wherein the bearing surfaces on the gear segments are concave and form grooves in the gear segments, and the bearing surfaces on the legs of the clamp member are convex and fit into the grooves of the gear segments.

6. A hinge comprising first and second hinge members, each having a gear segment along one of its edges and an initial leg segment projecting away from the gear segment, the gear segments meshing and enabling one hinge member to rotate relative to the other from a closed position, wherein the initial leg segments are generally together, to open positions, wherein the initial leg segments are spread apart, each gear segment having a channel about which its teeth curve, whereby the channel of the first and second gear segments open in opposite directions generally away from each other; and a clamp member having a connecting portion and legs projecting from the connecting portion such that the side faces of the two legs converge, the legs beyond the connecting portion having rod-like portions which fit into the channels of the gear segments and prevent the gear segments from separating, the side faces of the legs for the clamp member lying against the initial leg segments of the hinge members when the hinge members are in a fully open position, the convergence of the side faces for the legs of the clamping member being such that they do not come against the initial leg segments of the hinge members until the one hinge member has moved relative to the other hinge member in excess of 180° from the closed position.

7. A hinge according to claim 6 wherein the legs of the clamping member converge beyond the connecting portion.

8. A hinge according to claim 7 wherein, when the hinge members are closed, the initial leg segments of each hinge member is located at an obtuse angle with respect to that leg of the clamp member that is along the gear segment for that hinge member.

9. The pinless hinge structure according to claim 6 wherein said clamp member is a C-shaped channel like member having a multi-faceted exterior surface and defines the longitudinal rod-like bearing portions at inwardly turned ends thereof, the exterior surface of said clamp member cooperating with at least a portion of each outer surface on said hinge members to limit relative movement between said hinge members and said clamp member.

10. The pinless hinge structure according to claim 9 wherein said clamp member rotates in response to rotational movement of either hinge member, with said clamp member rotating approximately half the angular distance traversed by the rotational movement of the hinge member that is moved.

11. A hinge according to claim 6 wherein each hinge member is further provided with a seat which projects generally laterally beyond its initial leg segment and lies generally behind the groove for its gear segment such that the groove opens toward the seat; and wherein the connecting portion of the clamp member lies along the seats of the two hinge members when the hinge members are in their fully open position.

12. A hinge according to claim 11 wherein the initial leg segments of the hinge members lie generally parallel to each other when the hinge members are in their closed position.

13. A hinge according to claim 6 wherein the initial leg segments of the hinge members lie generally parallel to each other when the hinge members are in their closed position.

14. A hinge comprising: first and second hinge members, each having a leg segment and a gear segment attached to the leg segment and curving backwardly from it about a bearing surface on the gear segment and ending at a free edge, the gear segments meshing with their bearing surfaces presented in opposite directions; and a clamp member wrapped generally around the two gear segments such that the free edges of the gear segments are within the clamp member, the clamp member having a connecting portion and two legs, as well as bearing surfaces at the ends of the legs, with the bearing surfaces of the clamp member being against the bearing surfaces of the gear segments to prevent the gear segments form separating, yet permitting the gear segments to rotate relative each other, whereby one hinge member can rotate relative to the other between a closed position and a fully open position, the free edges of the gear segments being substantially against the inside faces of the legs on the clamp member when the hinge members are in their closed position, and the initial leg segments of the hinge members being substantially against the outside faces of the legs for the clamp member when the hinge members are in their fully open position, the angles and thickness of the legs on the clamp member being such that angle between the closed and fully open positions substantially exceeds 180°.

15. A hinge according to claim 14 wherein the initial leg segments of the hinge members are together and generally parallel when the hinge members are in their closed positions and each leg of the clamp member is located at an obtuse angle to the initial leg segment for the gear segment along which that leg lies.

16. A hinge according to claim 15 wherein each hinge member also has a seat extending generally laterally from its initial leg segment; and wherein the connecting portion of the clamp member is against the seats of the two hinge members when the hinge members are in their fully open position.

17. The pinless hinge structure according to claim 14 wherein said clamp member is a C-shaped channel-like member having inwardly turned ends defining rod-like bearing portions, one bearing portion rotatably engaging a gear segment of a hinge member at an axis of rotation thereof, and wherein each gear segment circularly extends in cross section through an angle of greater than 90 degrees.

18. The pinless hinge structure according to claim 14 further including thrust bearing means for inhibiting longitudinal movements of the hinge members relative to each other.

19. The pinless hinge structure according to claim 14 wherein the gear segment of each hinge member defines a longitudinally extended channel which rotatably accommodates an inwardly turned leg of said clamp member, and wherein each gear segment circularly extends in cross section through an angle of about 135 degrees.

20. The pinless hinge structure according to claim 14 wherein a seat is provided on the outer surface of each leg segment, with said seat having a profile which generally corresponds to and abuts against a portion of the exterior surface of said clamp member.

* * * * *